US006409403B1

(12) United States Patent
Woos

(10) Patent No.: US 6,409,403 B1
(45) Date of Patent: Jun. 25, 2002

(54) GLUE STICK

(75) Inventor: Michael T. Woos, Bay Village, OH (US)

(73) Assignee: Manco, Inc., Avon, OH (US)

( * ) Notice: Subject to any disclaimer, the term of this patent is extended or adjusted under 35 U.S.C. 154(b) by 0 days.

(21) Appl. No.: 09/711,477

(22) Filed: Nov. 13, 2000

(51) Int. Cl.[7] ..... B43K 73/00
(52) U.S. Cl. ..... 401/98; 401/88; 220/837; 220/836
(58) Field of Search ..... 401/98, 61, 88, 401/262; 206/385; 220/252, 836, 837

(56) References Cited

U.S. PATENT DOCUMENTS 1,969,027 A * 8/1934 Morrison ..... 401/98
3,217,869 A * 11/1965 Katz et al. ..... 401/98
5,150,978 A * 9/1992 Stewart et al. ..... 401/98
6,193,427 B1 * 2/2001 Benguigui ..... 401/98
6,247,865 B1 * 6/2001 Russell et al. ..... 401/98

* cited by examiner

*Primary Examiner*—David J. Walczak
(74) *Attorney, Agent, or Firm*—Vickers, Daniels & Young

(57) ABSTRACT

A glue stick product allows a user to hold the product in a natural pen-like orientation when applying glue to a substrate. The product has a cap which is separable along a mating line offset from perpendicular at about 35° with the upper part of the cap connected to the lower part by means of a live hinge.

10 Claims, 2 Drawing Sheets

GLUE STICK

BACKGROUND OF THE INVENTION

The present invention relates to glue sticks of the type used to apply glue in stationery application and more particularly to an improved cap for glue stick products featuring a snap-back "never lose the cap" and also allowing the product to be used in an off axis pencil-like orientation.

Glue sticks are commercially available products comprising a generally cylindrical body of solid adhesive contained within a generally cylindrical housing. Conventionally, the housing is closed by a removable cap with a circular opening on its bottom. The circular opening is in a plane perpendicular to the axis of the glue stick. The cap is removed when one wishes to use the glue stick. The exposed top surface of the body of glue is in a plane perpendicular to the axis of the glue stick. One therefore holds the glue stick in an orientation which is generally perpendicular to the surface upon which one uses to apply the glue. Thus, if one wishes to apply glue to a piece of paper on a horizontal desk surface, one will hold the glue stick in a vertical orientation to apply the glue to the piece of paper. When one is finished with the glue stick, the separate cap is reapplied and the glue stick put away.

While this conventional product has been commercially successful, applicant has found areas in which significant improvements can be made.

An area in which improvement can be made is the orientation of the glue stick when used. There are more natural ways in which one can hold an object when one is applying a workpiece to a piece of paper or the like. A pen-like grip resulting in an implement being off the vertical axis is natural for many people. Thus, the vertical orientation of conventional glue stick casings is a problem. Additionally, when one removes the cap from a glue stick, it is often lost, misplaced or simply left off. The glue then dries out and is no longer usable.

These disadvantages and others are addressed by applicant's invention as described below.

SUMMARY OF THE INVENTION

In accordance with the present invention, a glue stick is provided having a cylindrical body of glue surrounded by a cylindrical housing and a removable cap closing said housing. The cap is split into a lower portion and an upper portion at a plane other than perpendicular to the axis of the cap with the upper portion of the cap being disengageable from the lower portion of the cap.

Still further in accordance with the present invention, the upper portion of the cap is permanently fixed to the lower portion of the cap whereby the upper portion of the cap may be swung away from the lower portion of the cap allowing one to use the glue stick with the upper portion of the cap still attached to the glue stick.

Still further in accordance with the invention, the entire cap may be removed from the glue stick housing.

Yet further in accordance with the present invention, the upper portion of the glue stick housing and the lower portion of the glue stick housing are provided with a recess and rib arrangement where they mate and the upper portion of the glue stick housing may be releasably locked to the lower portion of the glue stick housing in the closed position.

Still further in accordance with the invention, the cap provides an "air-tight" seal which prevents the glue from drying out.

Yet further in accordance with the present invention, the upper portion of the glue stick housing is provided with a stud or rib which mates with a recess in the lower portion of the glue stick housing whereby the upper portion of the glue stick housing may be locked in the open position.

Still further in accordance with the present invention, the upper portion of the glue stick housing and the lower portion of the glue stick housing are split from one another on a plane which intersects the axis of the gap at an angle of about 35° from the perpendicular.

It is the principal object of the present invention to provide a glue stick which can be used to apply glue to a horizontal surface while held in a natural pen-like orientation.

It is yet another object of the present invention to provide a glue stick which allows one to apply glue from a large surface of a glue stick while holding the glue in a pen-like orientation or applying glue from a sharp edge of a body of glue either in a pen-like orientation or a vertical orientation.

It is yet another object of the present invention to provide a glue stick which presents an application surface of the glue which is oriented at an angle of about 35° with respect to the axis of the glue stick.

It is yet another object of the present invention to provide a glue stick which allows one to apply glue with the glue stick opened by separating the upper portion of the cap from the lower portion of the cap or by removing the cap in its entirety from the glue stick.

It is still another object of the present invention to provide a glue stick product in which the body of glue contained in the housing when the glue stick is no long usable is minimized.

It is still another object of the present invention to provide a glue stick product in which the glue is less likely to dry out as the glue stick product can be used without separating the cap from the housing.

It is yet another object of the invention to provide a cap hindering cap loss and minimizing the time to close between use.

It is still another object of the present invention to provide a glue stick which is inexpensive to manufacture, easy to use, and allows accurate application of glue to a substrate.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF THE PREFERRED EMBODIMENT

Figure 4:
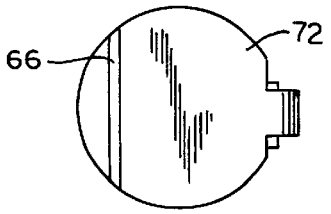
FIG. 4 is a top view of the glue stick seen in FIGS. 1–3.
Figure 2:
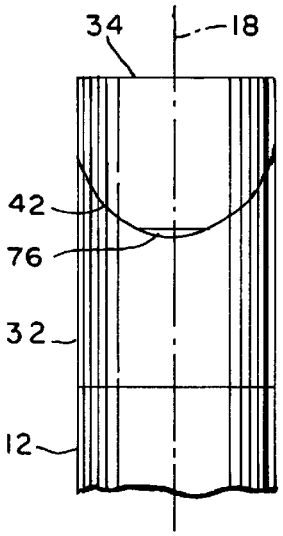
FIG. 2 is a front elevation showing the top half of the glue stick seen in FIG. 1.
Figure 1:
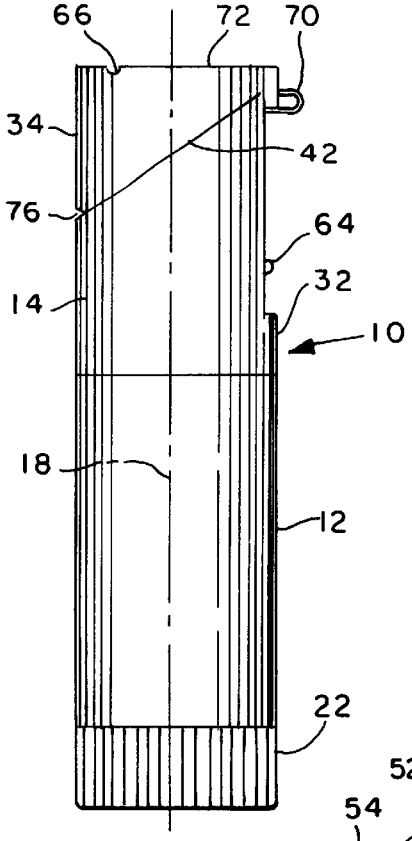
FIG. 1 is a side elevation view of a glue stick in accordance with the present invention.
Figure 7:
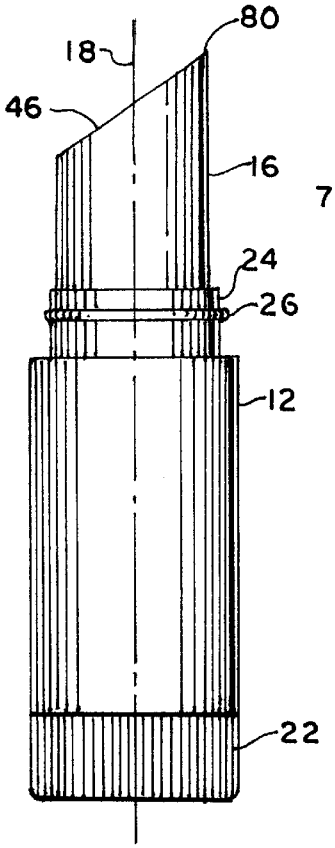
FIG. 7 is a view identical to FIG. 1 showing the glue stick with the cap removed.
Figure 8:
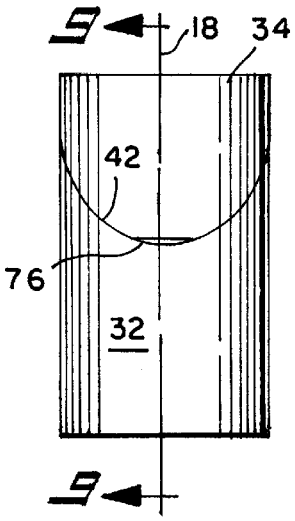
FIG. 8 is a front view of the cap only of the glue stick seen in FIGS. 1–7.

Referring now in greater detail to the drawings, wherein the showings are for the purposes of illustrating a preferred embodiment of the invention and not for the purposes of limiting same, a glue stick product 10 is shown in the closed configuration in FIG. 1. The glue stick product 10 is comprised of a generally cylindrical housing 12, a generally cylindrical cap 14, and a generally cylindrical body of glue 16 (FIG. 7). The glue 16 is solid but soft. It is easily transferred to a substrate such as paper or cardboard by rubbing it on the paper or cardboard with light pressure. Such glue is conventional and commercially available from a number of sources.

As seen in FIG. 7, the housing 12 has a rotatable element 22 on its bottom. The rotatable element 22 is connected to a conventional screw mechanism inside the housing 12. When the rotatable element is turned, the body of glue 16 is advanced upwardly making more glue available for use. The housing 12 has a generally uniform circular cross-section over most of its length. A housing top portion 24 has a reduced cross-section and a circumferential rib 26. The rib extends all the way around the housing top portion 24. The housing 12, the rotatable element 22, and the screw mechanism are all conventional.

Figure 6:
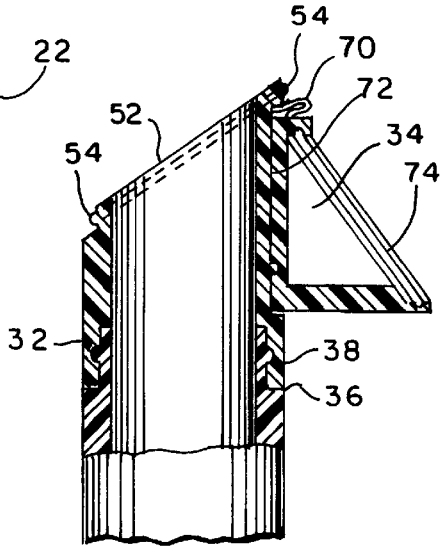
FIG. 6 is a view similar to FIG. 5 showing the upper portion of the cap in the open position.
Figure 9:
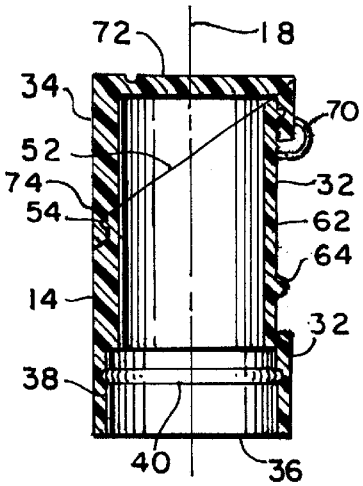
FIG. 9 is a cross-section of the cap taken along line 9—9 in FIG. 8.
Figure 10:
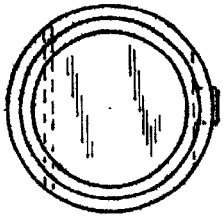
FIG. 10 is a bottom view of the cap seen in FIG. 9.

Referring to FIGS. 9, 6 and 1, the cap 14 is a unitary plastic structure having a lower portion 32 and an upper portion 34. The cap is somewhat flexible. The cap lower portion 32 and upper portion 34, when in the closed position, enclose a cylindrical volume which will cover and protect the body of glue 16. As can be best seen with reference to FIGS. 9 and 7, the cap 14 lower portion 32 has an open bottom 36 and a portion of enlarged cross-section 38 which will accommodate the housing top portion 24. The portion of enlarged cross-section has a circumferential recess 40 which engages the circumferential rib 26 on the housing 12. This holds the cap 14 on housing 12 but because of the flexibility of the cap material, allows one to remove the cap when desired.

The housing 12, cap 14, and body of glue 16 all share a central axis 18.

Figure 11:
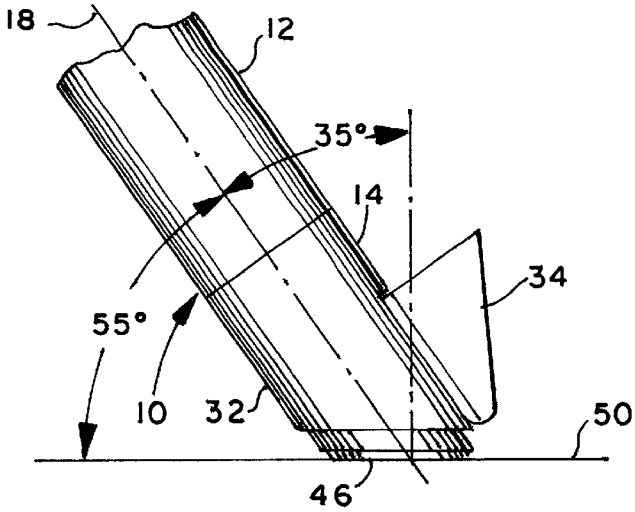
FIG. 11 is a simplified schematic of the glue stick in use.

As can be best seen in FIGS. 1 and 9, the cap upper portion 34 and lower portion 34 engage each other along a plane 42 which is offset about 35° with respect to perpendicular to the axis 18. When the cap 14 is assembled on the housing 12, the cap will support and protect the body of adhesive 16 with the top surface of the adhesive 46 exposed at the mating plane 42. This configuration is shown in FIGS. 7 and 9 with the cap separated from the housing 12 for purposes of clarity. However, it is contemplated that the glue stick 10 would be used with the cap on and open. This is necessary for the cap to support the body of glue for use without breaking. The top surface of the adhesive 46 is exposed and can be used as shown in FIG. 11. In the preferred embodiment, the body of glue is initially cylindrical with a top surface perpendicular to the axis 18. This maximizes product content. After initial use, the product works itself into a configuration having a 35° offset top surface 46 as seen in FIGS. 7 and 11. With the plane 42 now skewed 35° with respect to the axis 18, the top surface 46 is presented to a substrate 50 in a natural pen-like orientation. This allows a user to easily and accurately apply glue in a very comfortable configuration. Glue stick 10 will be used as illustrated in FIG. 11 with the cap on and in the configuration shown in FIG. 6. The cap upper portion 34 is opened and rotated around and locked to the side of the lower portion 32. The structures allowing this operation are described below.

As seen in FIG. 6, the cap lower portion 32 has a neck 52 of reduced cross-section extending above the mating plane 42. A rib 54 extends outwardly from the neck 52 and is parallel to the mating plane 42.

Figure 3:
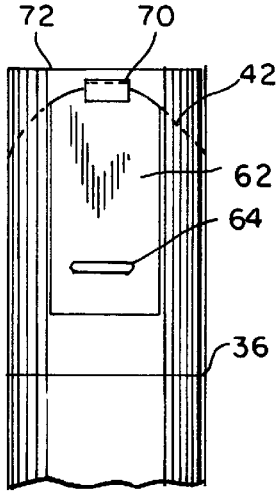
FIG. 3 is a back elevation of the glue stick seen in FIGS. 1 and 2.
Figure 5:
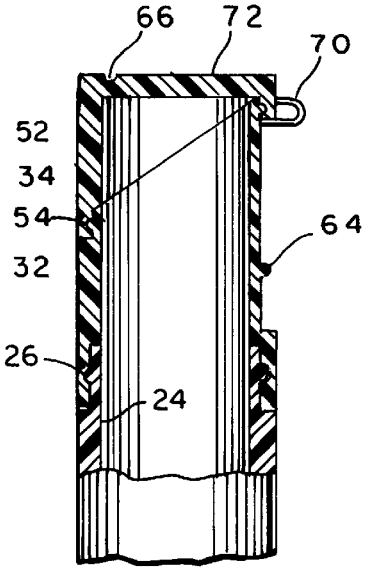
FIG. 5 illustrates the top half of the glue stick as shown in FIG. 1 with the cap and top portion of the housing shown in cross-section.

Referring to FIGS. 3 and 9, cap lower portion 32 has a slightly flattened side area 62 with a short rib 64 extending therefrom. The cap upper portion 34 has a slightly undercut recess 66 which will engage the rib 64 and lock to it when the cap upper portion 34 is in the fully open position as seen in FIG. 6. The cap upper portion 34 is permanently connected to the cap lower portion 32 by means of a live hinge 70. As seen in FIG. 6, the cap top portion 34 can be retained in the fully opened position by the rib 64 and recess 66. In this configuration, the upper portion 34 is retained on what will be the side of the glue stick 10 which is away from the substrate as used in FIG. 11. It is out of the way but permanently attached to the glue stick 10 and therefore cannot be lost. Flat top 72 lies conveniently and compactly against the side area 62 of lower portion 32. When one has completed use of the glue stick, one simply rotates the cap upper portion 34 around the live hinge 70 into the closed position as seen in FIGS. 1 and 9. A recess 74 which extends around the inner circumference of the upper portion 34 mates with the rib 54 on the lower portion 32 and locks the upper portion in the closed "air-tight" position. The glue is protected from drying out. The lowest portion of the cap upper portion 34 is cut away creating a small notch 76 allowing one to conveniently snap open the cap when one wishes to open the top portion and use the glue stick product 10.

One can also rotate the glue stick 10 one hundred eighty degrees (180°) about its axis 18. This allows one to apply small amounts of glue precisely by using the sharp corner 80 of the glue stick product. The entire cap 14 can also be removed allowing one to use up the last remnants of glue which will not extend above the mating plane 42.

Cap 14 is fabricated by injection molding or the like from a plastic material having some resiliency allowing one to repeatedly open and close the cap and/or remove the cap from the housing without damaging the cap. As described above, glue stick product 10 with the cap 14 in place allows one to use the glue stick product in a much more natural orientation than prior art glue stick products which had to be used vertically if one wished to apply the entire exposed surface of the glue to a substrate. A pen-like orientation is more natural for people used to handling pencils and pens and therefore allows for better control, precise location of glue, and less waste. Moreover, the ability to use the glue with the cap on and open and also to use the glue with the cap removed gives one the advantage of using all available adhesive. A more versatile product is created. Additionally, the top surface 46 created by use of the glue stick product with the cap in the open position has a larger surface area than conventional glue stick products. The surface 46 is oval in shape rather than circular. The user can apply a wider or narrower band of adhesive to a substrate by moving the glue stick in different directions with respect to the oval surface.

While considerable emphasis has been placed on structures and structural interrelationships between the component parts of a preferred embodiment of the invention, it will be appreciated that other embodiments and variations can be devised and that many changes can be made with respect to the preferred embodiments without departing from the principles of the invention. For instance, the flat side surface 62 can be dispensed with. The positioning of the rib 64 and recess 66 locking the cap in the open position can be reversed. The rib can be changed into a stud. It is to be distinctly understood that the foregoing description of a preferred embodiment is illustrative only and it is intended to include all modifications insofar as they come within the scope of the appended claims or the equivalents thereof.

Having thus described the invention, it is so claimed:

1. A glue stick product comprising:

a generally cylindrical housing having an axis and open top;

a body of solid glue having a top surface, said body of glue at least partially contained in said housing;

a mechanism adapted to urge said body of glue upwardly;

a cylindrical cap having an axis coincident with said housing axis adapted to engage said housing and close said top, said cap having an open bottom allowing said glue to enter said cap, a cylindrical side wall and a closed top, said cap being split into a lower portion and an upper portion at a plane intersecting said cap axis, said plane being other than perpendicular to said axis; and, said upper portion being movable between an open position in which at least a portion of said upper portion is separated from said cap lower portion and said body of glue top surface is exposed and a closed position in which said upper portion joins said lower portion and encloses said body of glue top surface.

2. A glue stick product comprising:

a generally cylindrical housing having an axis and open top;

a body of solid glue at least partially contained in said housing;

a mechanism adapted to urge said body of glue upwardly; and, a cylindrical cap having an axis coincident with said housing axis adapted to engage said housing and close said top, said cap having an open bottom allowing said glue to enter said cap, a cylindrical side wall and a closed top, said cap being split into a lower portion and an upper portion at a plane intersecting said cap axis, said plane being other than perpendicular to said axis, said cap upper portion and said cap lower portion joined at a hinge whereby said cap upper portion is adapted to rotate about said hinge to open said cap.

3. The glue stick product of claim 2, wherein said upper portion locks to said lower portion in a closed position.

4. The glue stick product of claim 3, wherein said hinge is a live hinge.

5. The glue stick product of claim 3, wherein said cap is a unitary plastic structure and said hinge is a live hinge.

6. The glue stick product of claim 1, wherein one of said cap lower portion and said cap upper portion is provided with an outwardly facing rib and the other of said lower portion and said cap upper portion is provided with a recess adapted to accept said rib whereby said cap lower portion and said cap upper portion may be releasably locked in the closed position providing an "air-tight closure."

7. A glue stick product comprising:

a generally cylindrical housing having an axis and an open top;

a body of solid glue at least partially contained in said housing; and, a generally cylindrical cap having an axis coincident with said housing axis adapted to engage said housing and close said housing top, an open bottom allowing said glue to enter said cap, a periphery a lower portion and an upper portion adapted to engage and close said lower portion along a plane, said plane being other than perpendicular to said axis, said upper portion being adapted to be displaced from said lower portion by rotation about an axis of rotation generally tangent to said cap periphery and adjacent said plane whereby said cap may be opened exposing said glue for use.

8. The glue stick product of claim 7, wherein said upper portion is connected to said lower portion by a live hinge.

9. A glue stick product comprising:

a generally cylindrical housing having an axis and open top;

a body of solid glue at least partially contained in said housing;

a mechanism adapted to urge said body of glue upwardly; and, a generally cylindrical cap having an axis coincident with said housing axis adapted to engage said housing and close said housing top, said cap having an open bottom allowing said glue to enter said cap, a cylindrical side wall and a closed top, said cap being split into a lower portion and an upper portion along a plane, said plane being other than perpendicular to said axis, said upper portion being joined to said lower portion at a hinge, said upper portion being rotatable about said hinge between a closed position and an open position whereby said body of glue may be advanced upwardly through said cap and applied to a substrate with said cap joined to said housing said hinge having an axis of rotation generally coincident with said cylindrical side wall and adjacent said plane.

10. The glue stick product of claim 9 wherein said cap upper portion is releasably retained in said closed position or said open position.

* * * * *